United States Patent [19]

Holmqvist et al.

[11] 4,168,734

[45] Sep. 25, 1979

[54] DEVICE FOR INSTALLING A ROLLER BLIND CASSETTE

[76] Inventors: Thure O. Holmqvist, Lundbovägen 53, S-852 46, Sundsvall; Lars C. Holmqvist, Sunnansjö 4204, S-860 35, Söräker, both of Sweden

[21] Appl. No.: 892,781

[22] Filed: Apr. 3, 1978

[30] Foreign Application Priority Data

Apr. 14, 1977 [SE] Sweden ..... 7704288

[51] Int. Cl.[2] ..... E06B 9/08

[52] U.S. Cl. ..... 160/23 R; 160/271

[58] Field of Search ..... 160/23, 39, 290 R, 28, 160/271–273; 248/251, 252, 261, 264, 216, 268, 201, 216, 300

[56] References Cited

U.S. PATENT DOCUMENTS

| | | | |
|---|---|---|---|
| 2,509,033 | 5/1950 | Carver | 160/84 R |
| 3,101,775 | 8/1963 | Antich | 160/290 R |

*Primary Examiner*—Peter M. Caun

[57] ABSTRACT

A roller blind cassette has two holders displaceable along the cassette to its ends when the cassette has been placed between two opposing elements of a window frame or the like, said elements having fixtures with projecting members engaging the holders at their end positions for holding the cassette in position.

6 Claims, 3 Drawing Figures

DEVICE FOR INSTALLING A ROLLER BLIND CASSETTE

The present invention relates to a device for installing a cassette containing a roller blind or the like, which is rolled up on a rod rotatably mounted in the end walls of such a box-shaped cassette, intended to be supported by a fitting at either end, each comprising a holder and a fixture, the holder carrying the cassette and mating with the fixture, which is attached to one of two opposing elements such as the side members of a casement window, a window frame or the like. The blind in question may consist of a thin aluminized plastic film, and can be used as a sunshade. In certain cases it is completely light-tight for use as a black-out curtain.

Installing such cassettes has taken place up to now with the help of fittings that are difficult to adjust in the right position. Mounting the cassette in the known fittings usually results in a small free gap between the end of the cassette and the part to which the fitting is attached. In certain cases, this gap can form a light passage, which is not desirable, e.g. in photographic laboratories. Another substantial disadvantage with the known fittings is that they must be taken away from their attachment before the cassette can be taken down, e.g. when the blind is to be changed. Taking down the fittings can often cause damage, e.g. to the paintwork of the part to which the fitting is attached. Removal and refitting are moreover time-consuming and troublesome.

The present invention has therefore the object of providing a device for installing such a cassette, said device being so arranged that the cassette can be quickly uncoupled from the fixtures, without using any tools, while the fixtures remain as they were and so that it is also possible to quickly and conveniently reinstall the cassette in its working position.

This is enabled by a device which, according to the invention, has the distinguishing features disclosed in the accompanying claims.

A suitable embodiment of the device according to the invention is shown as an example on the attached drawings.

Figure 1:
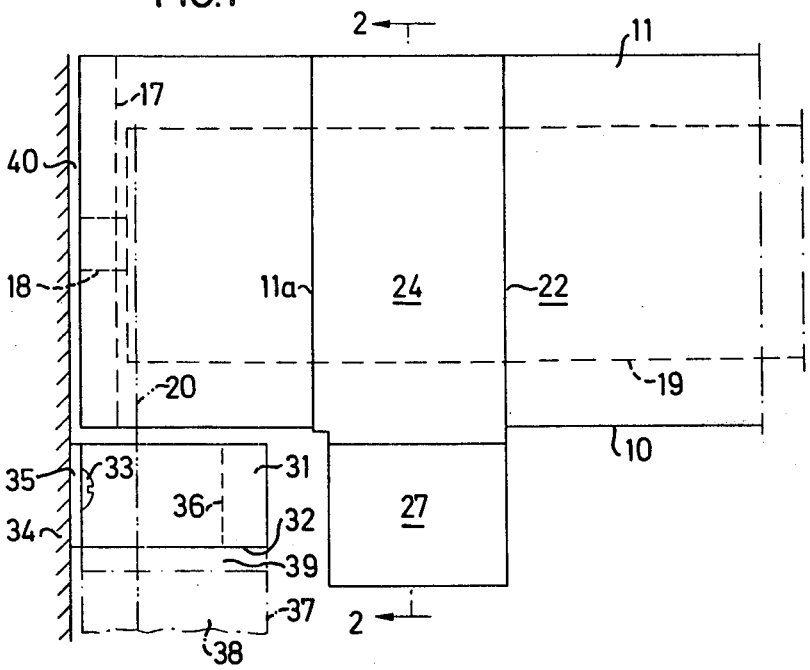
Figure 2:
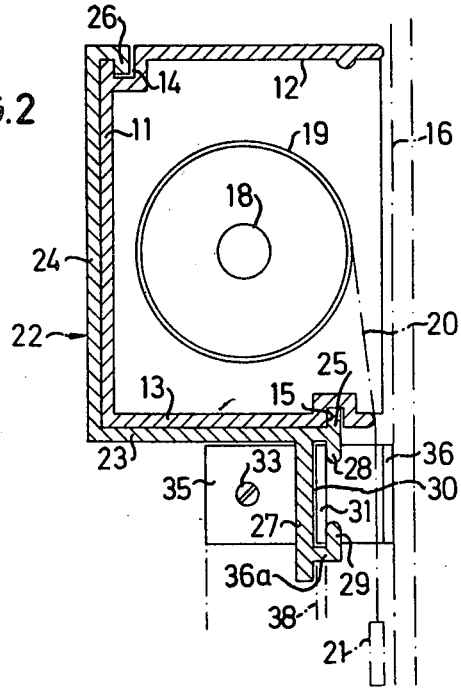
Figure 3:
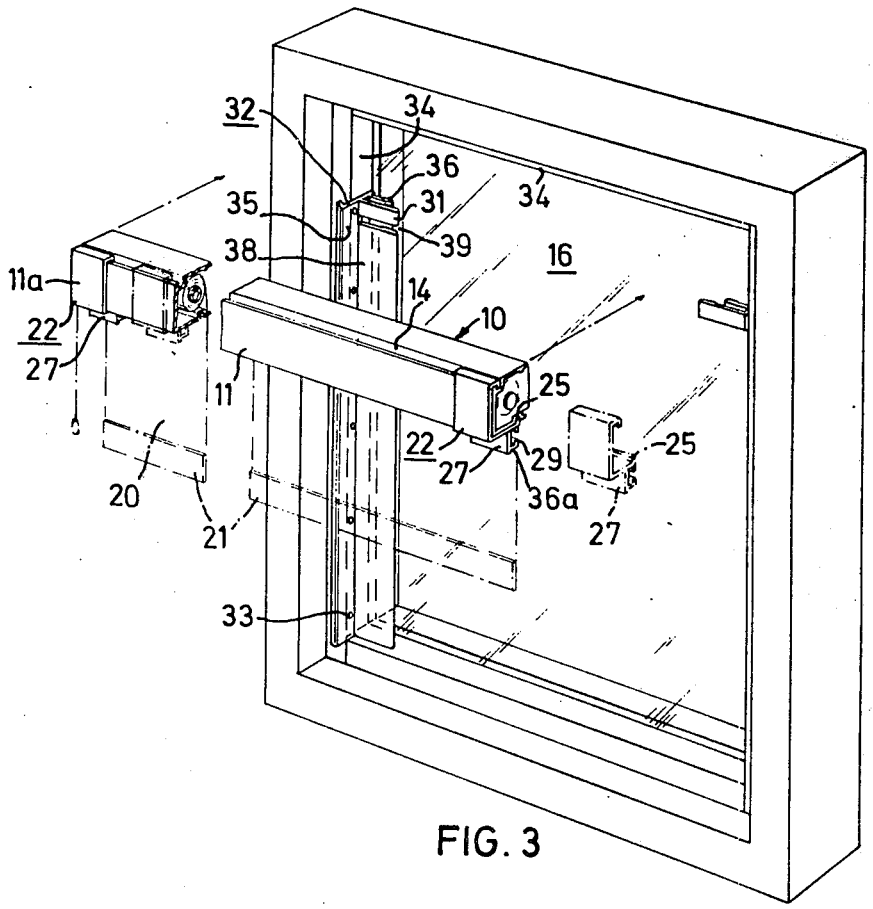

FIG. 1 is a view from the front of one end portion of the cassette and one of its two holders, in a position withdrawn from the supporting fixture attached to a casement window, FIG. 2 is a cross section along the line 2—2 in FIG. 1 through the holder and cassette, seen in a direction towards the fixture and also showing the fixture, and FIG. 3 is a diagrammatic exploded view of the cassette with its holder and its fixture mounted on a window frame.

For the sake of simplicity, only one end portion of the cassette, one holder and the associated supporting fixture will be described here since the configuration at the other end of the cassette, the other holder and the other fixture are exactly the same as the details shown.

The cassette 10 consists of a U-shaped section with a front wall 11, an upper wall 12 and a bottom wall 13.

At the forward edge portion of the upper wall there is a longitudinal groove 14. In the vicinity of the back edge of the bottom wall there is a further groove 15.

In FIG. 2 the cassette is shown in its operational position in the vicinity of a window pane 16.

At either end of the cassette there is fastened an end wall 17 forming a bearing for the end pin 18 of a cylinder constituting the rolling rod 19 for the blind 20. At the bottom edge of the blind there is a strip 21 which is sufficiently heavy to pull down the blind when the rod 19 is free for rotation. When the blind is drawn down, a pull cord on a reel inside the rod is simultaneously coiled up in a manner known per se. When this cord is pulled, the blind is once again rolled up on the rod and the cord subsequently fastened.

Two holders are pushed onto the cassette, one holder 22 being shown in the figures. Each holder consists of an angled section with a horizontal limb 23 on which the cassette rests, and a vertical limb 24 following the front wall 11 of the cassette. The horizontal limb 23 is formed at its inner edge with a ridge 25 parallel to, and accommodated in the groove 15 on the lower side of the bottom wall 13 of the cassette.

The vertical limb 24 of the holder grips round the upper edge of the front wall 11 of the cassette, and is made with a downwardly directed ridge 26 parallel to, and accommodated in the groove 14 in the upper side of the upper wall 12.

The holder 22 can thus easily be displaced backwards and forwards along the cassette in its longitudinal direction.

On the lower side of the horizontal limb 23 of the holder there is a longitudinally depending portion 27 formed with a T-slot 30 having an upper flange 28 and a lower flange 29, for accommodating a rigid cantilever plate 31 included in a fixture 32, which is attached by a screw 33 to one of the opposing members of a casement window 34, for example.

The cantilever plate is carried by an attachment plate 35, forming the bottom plate of the fixture 32.

When the cassette is held in the position shown in FIG. 1, the T-slot 30 with the flanges 28,29 formed in the plate 27 will be aligned with the cantilever plate 31, it then only being necessary to push the holder 24 towards the cantilever plate for this to enter the T-slot 30, thereby connecting the holder to the fixture 32. When the other holder has been pushed onto its fixture at the other end of the cassette the cassette is properly installed.

To remove the cassette, the holders 22 are simply drawn towards each other, allowing it to be easily removed, e.g. for changing the blind. Installing the cassette is done in the same simple way, without having to remove the fixtures 32.

The fixture is further provided with a covering plate 36 parallel to the cantilever plate and at such a distance from it that the end portion of the blind 20 can run between both plates 27,36 as shown in FIG. 2.

The fixture 32 can constitute the upper end of a formed strip 37 with the same cross section, so that the formed strip is an extension of the fixture. This formed strip 37 is indicated by chain dotted lines in FIG. 2, and covers the edge portion of the blind along the whole length of the completely lowered blind. The end portion of one flange 38 of the strip, also forming the cantilever plate 31 of the fixture, is provided with a slit 39 adjacent to the plate 35 for allowing a free space for the horizontal portion **36*a* of the lower T-slot flange 29**.

In order to install a cassette, it must usually have a length which is slightly less than the distance between the opposing elements 34, forming the side members of a casement window, for example. A small space 40 is thereby obtained between the element 34, to which the fixture 32 is attached, and the end of the cassette 10. In fittings for cassettes known up to now, this space is not covered, and light can get past the cassette at this location. This is, however, prevented in a simple way by the holder 22, the vertical limb 24 of which is extended with an edge portion 11*a*, which, after pushing the holder over the cantilever plate 32 will extend above and past the fixture 32 to engage against the element 34 for completely covering the space 40, so that light leakage is prevented. This extension 11*a* can have different embodiments for accurately adjusting to the part in question, e.g. a casement window, to which the fixture is attached.

What we claim is:

1. Apparatus for mounting a window blind assembly within a window frame or the like, comprising (a) a hollow cassette housing (10) having in transverse cross-section a U-shaped configuration including a vertical front wall (11), horizontal top and bottom walls (12,13), and a pair of end walls for supporting therebetween a window blind roll; and (b) means for mounting said housing between the vertical members of the window frame, including (1) a pair of fittings (32) adapted for fastening at opposed locations on the vertical portions of the frame, respectively;

(2) a pair of holder members (22) slidably connected with said housing for linear displacement in a direction normal to said end walls, each of said holders including a vertical wall (24) adjacent said housing front wall, a downwardly directed ridge (26) connected with the upper portion of said vertical wall and extending into a corresponding groove (14) contained in the upper surface of said housing top wall, a lower horizontal limb portion (23) connected with the lower end of said vertical wall portion and extending beneath said housing bottom wall, an upwardly directed ridge (25) carried by said limb portion and extending with a corresponding groove (15) contained in the lower surface of said bottom wall, said grooves being parallel with and spaced from said front wall and extending substantially the length of said housing; and (3) connecting means (30,31) operable when said housing is positioned between said fittings and when said holder members are displaced apart for connecting said holder members with said fittings, respectively.

2. Apparatus as defined in claim 1, wherein said connecting means comprises a male portion (31) on each of said fittings adapted for sliding insertion within a corresponding slot (30) contained in a depending portion (27) of the associated holder member, respectively.

3. Apparatus as defined in claim 2, and further wherein said slot is defined in said depending portion by a plate (27) having on one side an upper flange (28) and a lower opposing flange (29), said male portion (31) comprising a fixed plate (31) formed on said fitting (32) adapted for sliding insertion into said slot between the opposing faces of said upper and lower flanges and said plate.

4. A device as claimed in claim 3, characterized in that the fitting is formed with a further plate (36) parallel to the connecting plate (31) and at a distance from it such that the edge portion of the blind (20) can run between these plates.

5. A device as claimed in claim 1, characterized in that the fitting is extended downwardly as a rail (38) with the same section as the fitting and with two flange-like strips between which the edge portion of the blind runs to prevent light from passing the edge of the blind.

6. A device as claimed in claim 1, characterized in that each holder is made with an extension (11*a*) at one edge of its front wall, in a direction towards the adjacent end of the cassette so that after connecting the holder to the fitting, this extension will engage against the member (34) to which the fitting is attached, thereby bridging over the possible base (40) between this part and the end of the cassette.

* * * * *

UNITED STATES PATENT AND TRADEMARK OFFICE

CERTIFICATE OF CORRECTION

PATENT NO. : 4,168,734

DATED : September 25, 1979

INVENTOR(S) : Thure O. Holmqvist and Lars C. Holmqvist

It is certified that error appears in the above-identified patent and that said Letters Patent are hereby corrected as shown below:

In the Heading, please add:

-- /73/ Assignee: TESAB SVENSKA AB
Sundsvall, Sweden --

Signed and Sealed this

*Eighth* Day of *April 1980*

[SEAL]

*Attest:*

SIDNEY A. DIAMOND

*Attesting Officer*

*Commissioner of Patents and Trademarks*